US008555514B2

(12) United States Patent
Jensen

(10) Patent No.: US 8,555,514 B2
(45) Date of Patent: Oct. 15, 2013

(54) COLLAPSIBLE MULTIBLADE THROWING WEAPON

(76) Inventor: Harvey Jensen, Santa Barbara, CA (US)

( * ) Notice: Subject to any disclaimer, the term of this patent is extended or adjusted under 35 U.S.C. 154(b) by 379 days.

(21) Appl. No.: 13/085,177

(22) Filed: Apr. 12, 2011

(65) Prior Publication Data

US 2012/0260507 A1 Oct. 18, 2012

(51) Int. Cl.
*F41B 15/00* (2006.01)
*B26B 1/04* (2006.01)

(52) U.S. Cl.
USPC ..... 30/303; 30/152; 30/155; 30/161; 30/302

(58) Field of Classification Search
USPC ..... 30/152, 153, 302, 303, 155, 161; 473/588, 589
See application file for complete search history.

(56) References Cited

U.S. PATENT DOCUMENTS 3,600,729 A * 8/1971 Laughlin et al. ..... 7/118
4,027,389 A * 6/1977 Atchisson ..... 30/303
4,096,629 A * 6/1978 Levine ..... 30/152
4,502,219 A * 3/1985 Hibben ..... 30/153
4,606,125 A * 8/1986 Jensen ..... 30/302
4,608,757 A * 9/1986 Eckerle ..... 30/299
4,807,362 A * 2/1989 Prentice ..... 30/155
2012/0260507 A1* 10/2012 Jensen ..... 30/303

FOREIGN PATENT DOCUMENTS

FR 2 629 578 * 10/1989

* cited by examiner

*Primary Examiner* — Hwei C Payer
(74) *Attorney, Agent, or Firm* — Felix L. Fischer

(57) ABSTRACT

A collapsible multiblade throwing weapon incorporates a first blade having a shank from which a blade portion extends with a butt portion extending from the shank opposite the blade portion. The shank incorporates an aperture for a first axle and an eyelet extending from the butt portion for a second axle. Second and third blades each have an aperture which receives the first axle for rotation of the blade on the axle and each blade has a closed position engagement cutout and an open position engagement cutout. First and second pawls, associated with the second and third blades respectively, each have an eyelet receiving the second axle. The pawls rotate about the second axle for resiliently engaging the closed position engagement cutout with the associated blade in a closed position and the open position engagement cutout with the associated blade in an open position.

7 Claims, 7 Drawing Sheets

COLLAPSIBLE MULTIBLADE THROWING WEAPON

BACKGROUND INFORMATION

1. Field

Embodiments of the disclosure relate generally to the field of bladed weapons and more particularly to embodiments for a multiblade throwing weapon with the blades extendible from an aligned position to an equal angled throwing position and collapsible from the throwing position to the aligned position with an additional ability to freely rotate.

2. Background

Bladed throwing weapons have been known in the martial arts field for centuries. However, to conveniently carry a multibladed "star" or similar weapon collapsing of the blades is required. The inventor of the present application has developed devices disclosed in U.S. Pat. No. 4,765,628 Fighting Weapon and U.S. Pat. No. 4,606,125 Throwing Weapon which partially address this issue. However, a structure for collapsing and manipulating the blades of a multibladed throwing weapon which operates easily for use in both exhibition and actual combat has not been available in the prior art.

It is therefore desirable to provide a multibladed throwing weapon with blades collapsible into an aligned position for easy carrying and having a locking mechanism which allows easy extension and collapsing of the blades.

SUMMARY

Embodiments described herein provide a collapsible multiblade throwing weapon which incorporates a first blade having a shank from which a blade portion extends with a butt portion extending from the shank opposite the blade portion. The shank incorporates an aperture for a first axle and an eyelet extending from the butt portion for a second axle. Second and third blades each have an aperture which receives the first axle for rotation of the blade on the axle and each blade has a closed position engagement cutout and an open position engagement cutout. First and second pawls, associated with the second and third blades respectively, each have an eyelet receiving the second axle. The pawls rotate about the second axle for resiliently engaging the closed position engagement cutout with the associated blade in a closed position and the open position engagement cutout with the associated blade in an open position.

The features, functions, and advantages that have been discussed can be achieved independently in various embodiments of the present invention or may be combined in yet other embodiments further details of which can be seen with reference to the following description and drawings.

DETAILED DESCRIPTION

Figure 1:
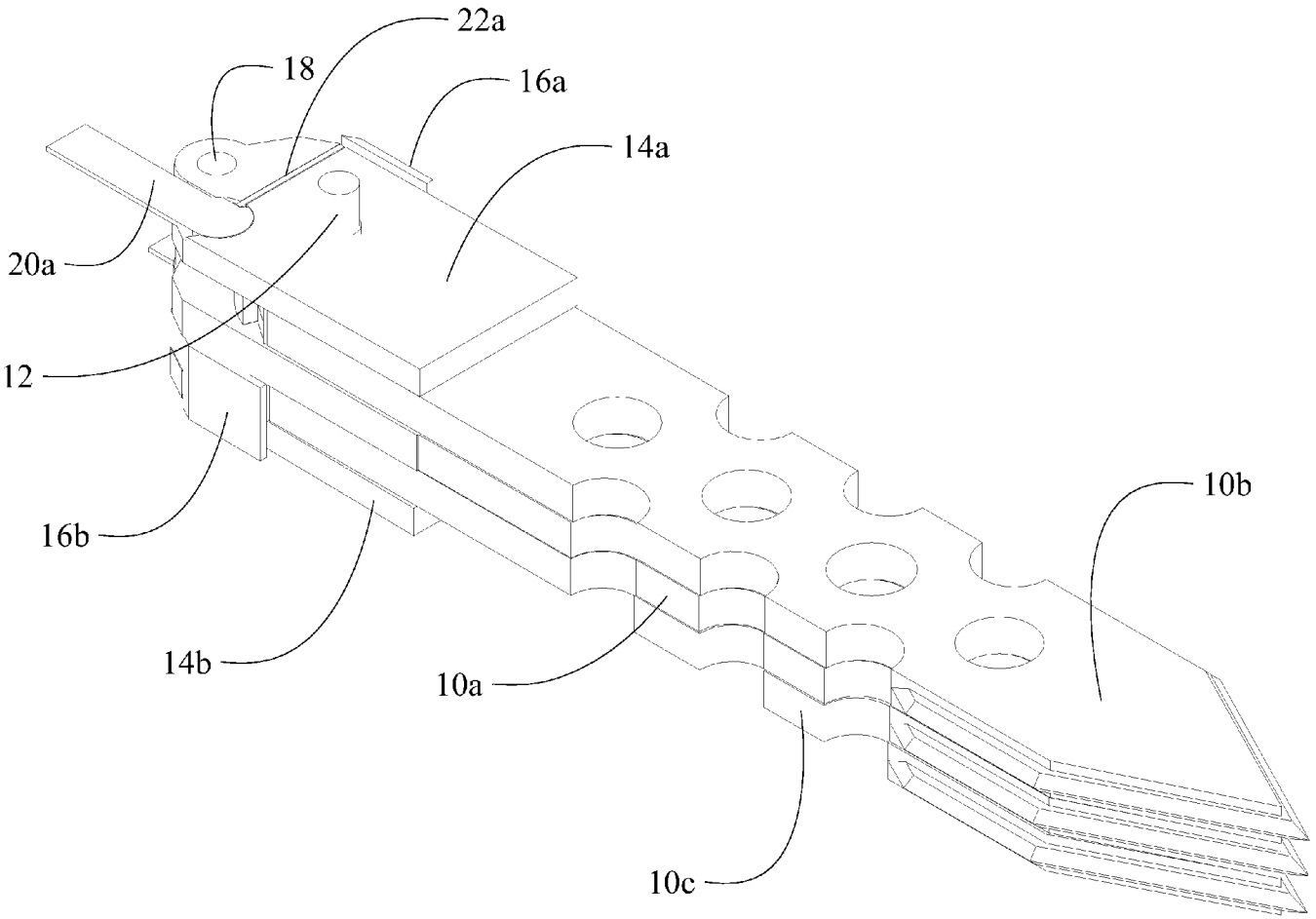
FIG. 1 is a top isometric view of the device with the blades in the closed/aligned position.
Figure 2:
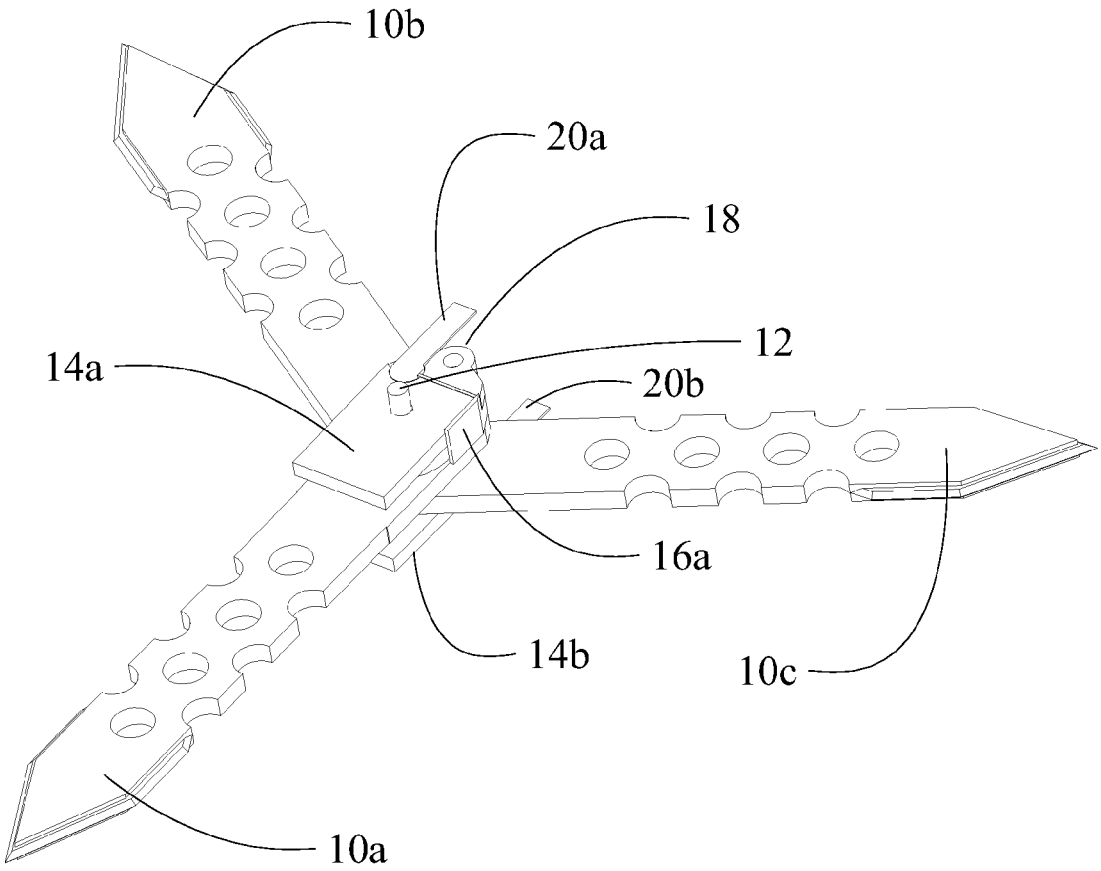
FIG. 2 is top isometric view of the device in the expanded open position.
Figure 3:
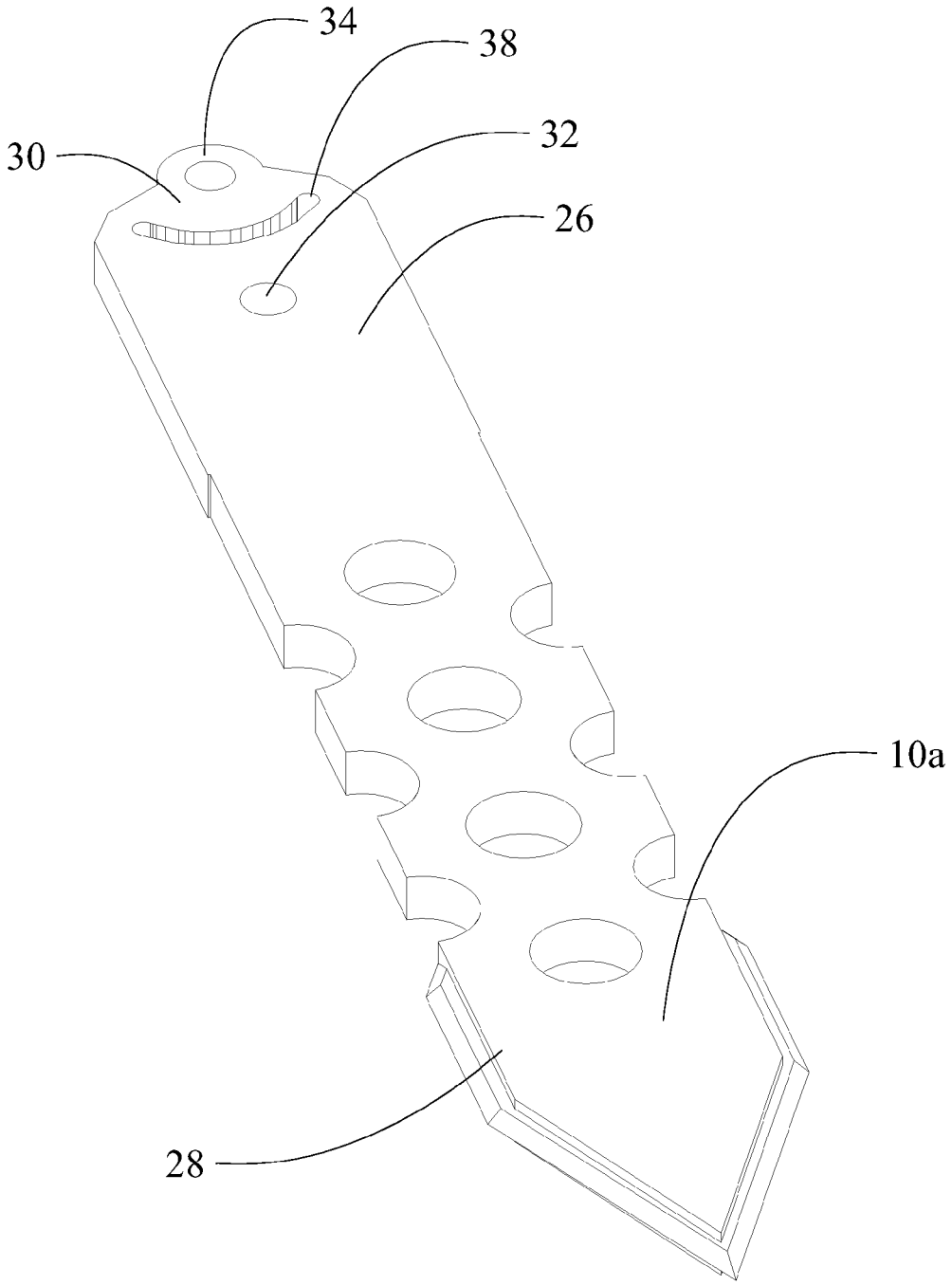
FIG. 3 is a top isometric view of the fixed blade.

The throwing weapon shown in the embodiments herein includes three blades 10*a*, 10*b* and 10*c* which rotate relative to one another on an axle 12 from a closed or aligned position as shown in FIG. 1 to an open or expanded position as shown in FIG. 2. End plates 14*a* and 14*b* retain the blades in position on the axle and secure locking pawls 16*a* and 16*b* associated with blades 10*b* and 10*c* respectively on a second axle 18. Blade 10*a* provides a fixed end as shown in FIG. 3 has a shank 26 from which a blade portion 28 extends with a butt portion 30 extending from the shank opposite the blade portion. The shank incorporates an aperture 32 for axle 12 and an eyelet 34 extending from the butt portion for second axle 18.

Figure 4:
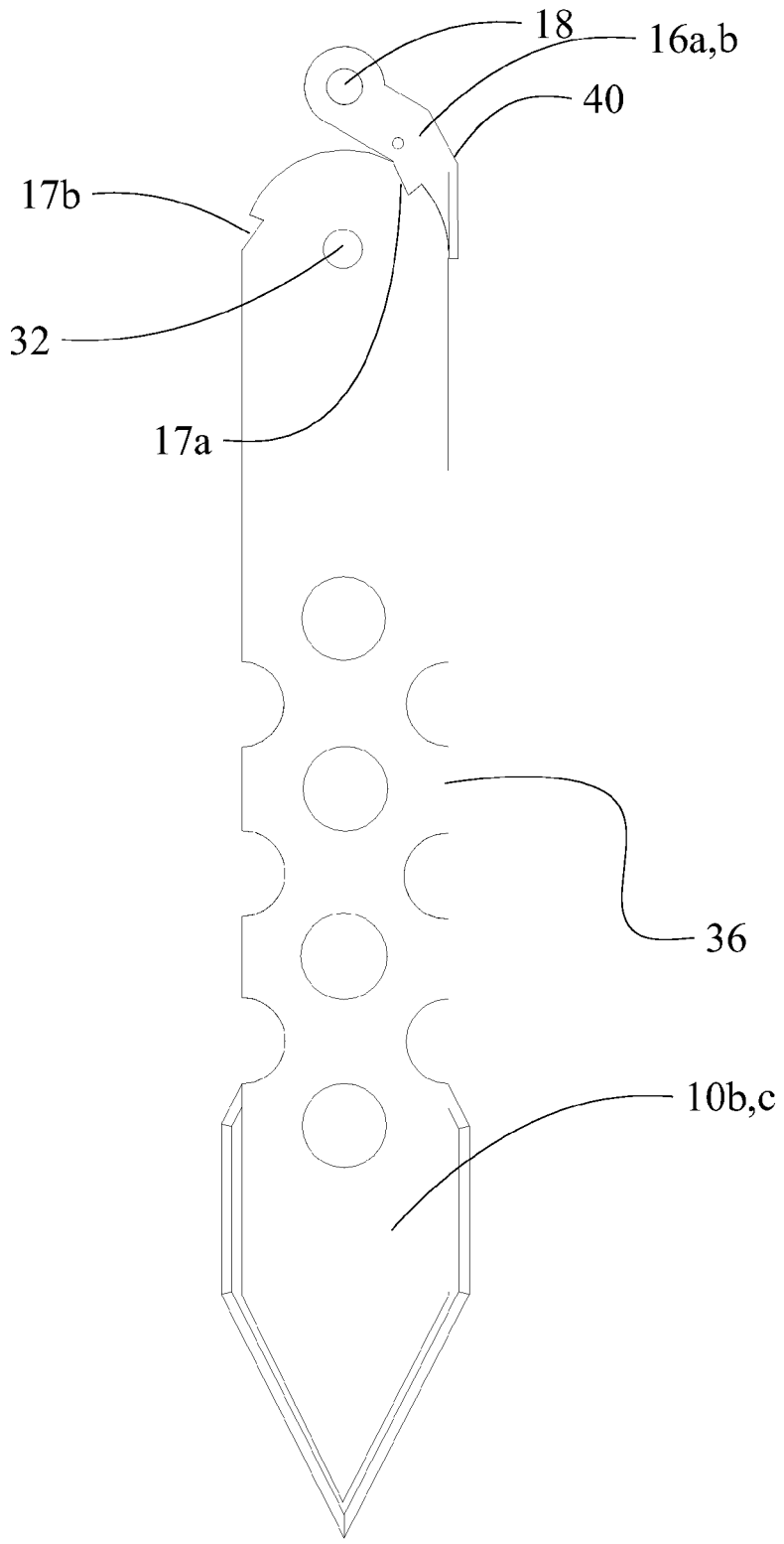
FIG. 4 is a top view of one movable blade and associated locking pawl in the blade closed position.
Figure 5:
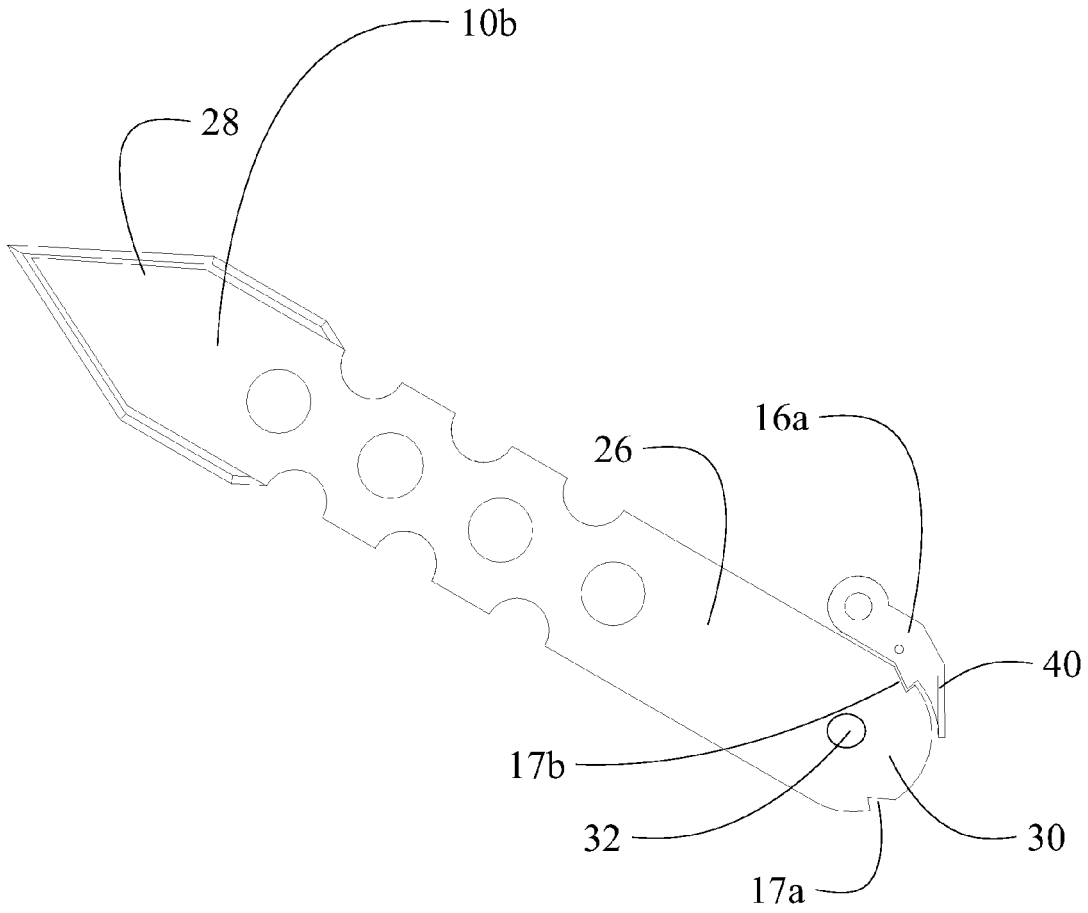
FIG. 5 is a top view of the movable blade of FIG. 4 with the blade and associated locking pawl in the blade open position.

Blades 10*b* and 10*c*, shown in FIGS. 4 and 5, are movable with respect to blade 10*a*, rotating on axle 12 which extends through apertures 32. Locking pawls 16*a* and 16*b* are received within engagement cutouts 17*a* (in the closed position as shown in FIG. 4) or 17*b* (in the open position as shown in FIG. 5). The closed position cutout 17*a* prevents rotation of the movable blade past an aligned position with the fixed blade. However, the geometry of the cutout allows the blade to rotate to the open position with lateral force on the blade either created by the user exerting force against the trailing side of the blade 36 or by centripetal force created by rapidly angularly "snapping" the weapon about the axle either while in hand or by throwing. The pawls incorporate eyelets 23 which receive second axle 18 for rotation about the second axle 18 and are resiliently urged into contact with the blade butt and position cutouts by a spring 19, carried in groove 38 in the shank 26, which is engaged at each end by pins 21 extending from the pawls. In alternative embodiments, grooves in the individual end plates each carry a spring for the associated pawl. The open position cutout 17*b* locks the blade in an open position requiring lateral displacement of the pawl to release the pawl from the open position cutout. Vertical flanges 40 on each pawl provide an actuation lever for such displacement.

Figure 6:
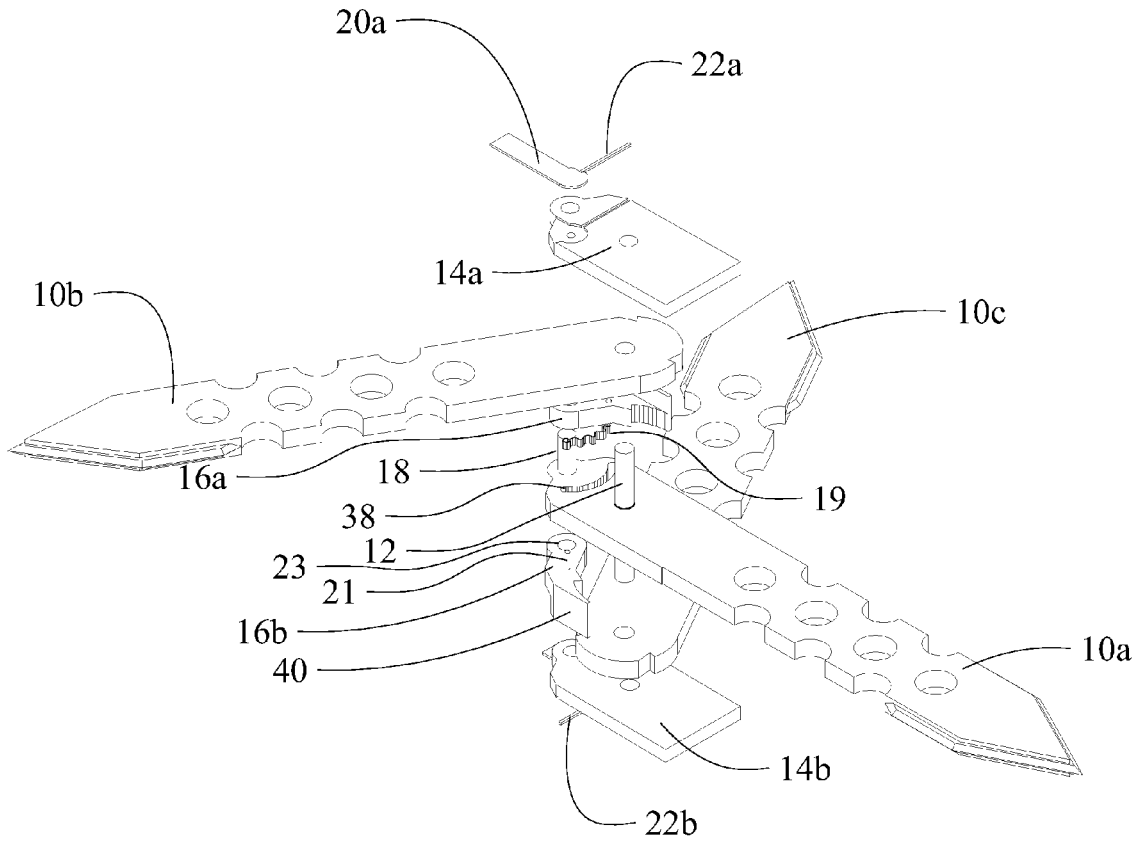
FIG. 6 is an exploded isometric showing the element of the device.

Blades 10*b* and 10*c* and associated pawls 16*a* and 16*b* are mounted on axles 12 and 18 in inverse symmetry on opposite sides of the fixed blade 10*a* as shown in FIGS. 1, 2 and 6.

For release of the open blades in a first embodiment, a cammed lever 20*a* and 20*b* on each end plate engages a push rod 22*a* or 22*b* respectively which is urged against the vertical flange for displacing the flange. Alternatively the user may directly urge the flange laterally with direct finger pressure.

Figure 7:
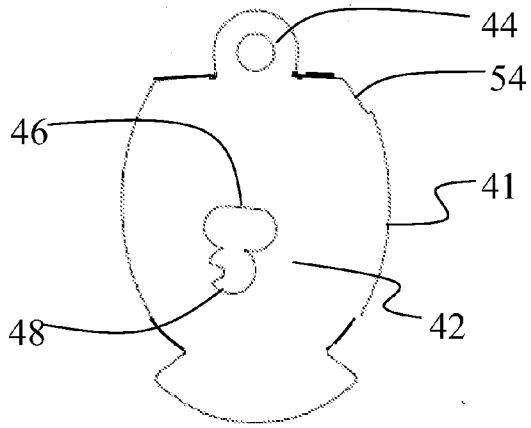
FIG. 7 is a top view of an alternative embodiment with modified end plate; and, FIGS. 8A and 8B are transparent top views of the embodiment of FIG. 7 with the end plate shown in conjunction with the center blade shank and modified pawl configuration in a latching position and in a locked open position.
Figure 8A:
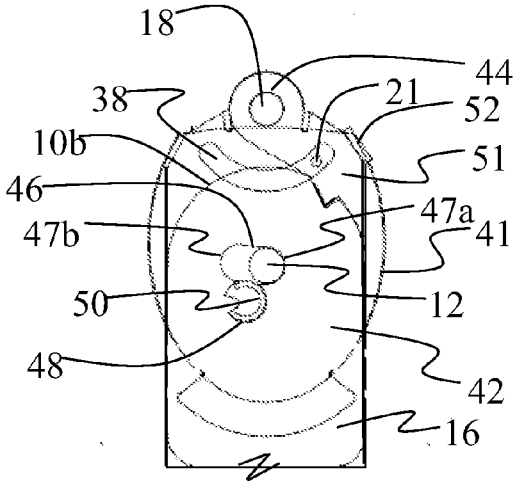
Figure 8B:
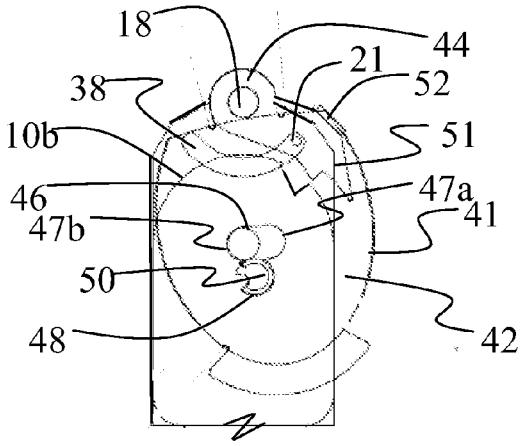

In an alternative embodiment, the end plates are modified to allow deletion of the cammed levers and push rods. As shown in FIGS. 7, 8A and 8B, a modified end plate 41 includes a body portion 42 and an extending eyelet 44 for engaging second axle 18. An oblong center bore 46 receives axle 12 with an adjacent aperture 48 housing a "C" spring 50 which resiliently engages the axle 12 to urge the end plate into position with the axle at one end or the other of the oblong center bore, as described in greater detail subsequently.

FIGS. 8A and 8B are shown with all elements depicted transparently to show all features of the layered elements. A modified pawl 51 has an angled vertical flange 52 which engages a flat 54 on the body portion 42. As described with respect to the prior embodiment, a spring (not shown) held in groove 38 in shank 26 connects to pin 21 to urge the pawl inward for engagement of the open and closed position cutouts on the moving blades (not shown for clarity of other components in FIGS. 8A and 8B but substantially identical to elements 10*b* and 10*c* as shown in FIGS. 4 and 5). End plate 41 is rotatable about second axle 18 and with axle 12 carried in a first end 47*a* of the oblong center bore 46 in the end plate 41 allows symmetric alignment of the end plate 41 with the center blade shank 26. With the end plate symmetrically aligned with the shank engaged position as shown in FIG. 8A, the pawl contacts the engagement cutouts in the movable blades in the open or closed position as previously described.

As shown in FIG. 8B, rotation of the end plate 41 about second axle 18 such that axle 12 is carried in a second end 47*b* of the oblong center bore 46 urges the pawl 51 outward disengaging from the open and closed position cutouts allowing free motion of both movable blades. Transition of axle 12 from the first end 47*a* to the second end 47*b* of the oblong center bore compresses "C" spring 50 which then rebounds to urge the axle 12 to maintain close contact with the second end 47*b*. In this offset position, free relative rotation of the three blades is available for handling or exhibition. Rotating the end plate 41 back to the symmetrically aligned position returning axle 12 to the first end 47*a* of the oblong center bore, compressing "C" spring 50 in transition, allows the pawl 51 urged its associated spring to reengage the open or closed position cutouts of blades 10*b* and 10*c* in the expanded or collapsed position as desired.

In an example embodiment, a medallion or stone may be secured to the top surface of the end plate 41 for decorative purposes and to shield and constrain the exposed end of axle 12 and "C" spring 50.

The embodiments described each provide two movable blades rotatable about an axle relative to a fixed blade from a first closed position with the blades aligned and a second open position with the blades spaced equally at 120 degree intervals, the movable blades are maintained in the aligned position and locked in the open position with associated pawls secured for rotation about a second axle.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A collapsible multiblade throwing weapon comprising:

a first blade having a shank from which a blade portion extends with a butt portion extending from the shank opposite the blade portion, said shank incorporating an aperture for a first axle and an eyelet extending from the butt portion for a second axle;

second and third blades each having an aperture receiving and rotating on the first axle, said second and third blades each having a closed position engagement cutout and an open position engagement cutout; and, first and second pawls, associated with the second and third blades respectively, each having an eyelet receiving the second axle, said pawls rotating about the second axle for resiliently engaging the closed position engagement cutout with its associated blade in a closed position and for resiliently engaging the open position engagement cutout with its associated blade in an open position.

2. The collapsible multiblade throwing weapon defined in claim 1 wherein the second and third blades and their associated first and second pawls are mounted in inverse symmetry on opposite sides of the first blade.

3. The collapsible multiblade throwing weapon defined in claim 1 further comprising a spring carried in a groove in the shank of the first blade, said spring attached to the first and second pawls for resilient engagement of the open and closed position engagement cutouts of the associated blade.

4. The collapsible multiblade throwing weapon defined in claim 3 further comprising end plates to retain the second and third blades in position on the first axle and secure the first and second locking pawls on the second axle.

5. The collapsible multiblade throwing weapon defined in claim 4 wherein the first and second pawls each incorporate a vertical flange for use as an actuation lever for displacement of the pawl.

6. The collapsible multiblade throwing weapon defined in claim 5 further comprising a cammed lever on each end plate engaging a push rod which is urged against the vertical flange for displacing the vertical flange.

7. The collapsible multiblade throwing weapon defined in claim 5 wherein the end plates each incorporate a body portion and an extending eyelet for engaging the second axle and an oblong center bore receiving the first axle with an adjacent aperture housing a "C" spring resiliently engaging the first axle to urge the end plate into a symmetrically aligned position with the first axle at a first end of the oblong center bore or an offset position with the first axle at a second end of the oblong center bore, a flat on said end plate engaging an associated pawl vertical flange to displace the vertical flange outward in the offset position disengaging the pawl from the open and closed position cutouts.

* * * * *